US006865523B2

(12) United States Patent
Varghese et al.

(10) Patent No.: US 6,865,523 B2
(45) Date of Patent: Mar. 8, 2005

(54) NON-LINEAR AXISYMMETRIC POTENTIAL FLOW BOUNDARY MODEL FOR PARTIALLY CAVITATING HIGH SPEED BODIES

(75) Inventors: Abraham N. Varghese, Wakefield, RI (US); James S. Uhlman, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 828 days.

(21) Appl. No.: 09/874,306

(22) Filed: Jun. 7, 2001

(65) Prior Publication Data

US 2003/0019978 A1 Jan. 30, 2003

(51) Int. Cl.[7] ..... G06G 7/48; G06G 7/50

(52) U.S. Cl. ..... 703/9; 703/1; 703/2; 703/8; 703/6; 440/113

(58) Field of Search ..... 703/1–2, 6–9; 440/113

(56) References Cited

U.S. PATENT DOCUMENTS 5,024,396 A * 6/1991 Guevel et al. ..... 244/35 R
5,717,657 A * 2/1998 Ruffa ..... 367/131

OTHER PUBLICATIONS

Leger et al, "Examination of the Flow Near the Leading Edge and Closure of Stable Attached Cavitation," 21$^{st}$ Symposium on Naval Hydrodynamics, pp. 783–793 (1997), available at: http:/www.nap.edu/openbook/0309058791/html/783.html.*

Chahine, "Numerical Simulation of Cavitation Dynamics," Proccedings of the 2$^{nd}$ LAAS Conference on Computer Simulation, pp. 1–9 (Sep. 1997), available at: http://www.dynaflow–inc.com/Reports/NumSimofCavDynam_1997.PDF.*

Paster, "Importance of Hydrodynamic Considerations for Underwater Vehicle Design," Oceans, vol. 18, pp. 1413–1422 (Sep. 1986).*

Brennen, "Cavitation and Other Free Surface Phenomena," Ph.D. Thesis, Oxford University (Sep. 1966), available at: http://resolver.caltech.edu/Caltech/AUTHORS:BREou66.*

* cited by examiner

*Primary Examiner*—Samuel Broda
(74) *Attorney, Agent, or Firm*—James M. Kasischke; Michael F. Oglo; Jean-Paul A. Nasser

(57) ABSTRACT

A method for calculating parameters about an axisymmetric body in a cavity is provided. The user provides data describing the body, a cavity estimate, and convergence tolerances. Boundary element panels are distributed along the body and the estimated cavity. Matrices are initialized for each panel using disturbance potentials and boundary values. Disturbance potential matrices are formulated for each panel using disturbance potential equations and boundary conditions. The initialized matrices and the formulated matrices are solved for each boundary panel to obtain panel sources, dipoles and cavitation numbers. Forces and velocities are computed giving velocity and drag components. The cavity shape is updated by moving each panel in accordance with the calculated values. The method then tests for convergence against a tolerance, and iterates until convergence is achieved. Upon completion, parameters of interest and the cavity shape are provided. This invention also allows determiniation of cavity shape for a cavitation number.

12 Claims, 3 Drawing Sheets

NON-LINEAR AXISYMMETRIC POTENTIAL FLOW BOUNDARY MODEL FOR PARTIALLY CAVITATING HIGH SPEED BODIES

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED PATENT APPLICATIONS

Not applicable.

BACKGROUND OF THE INVENTION (1) Field of the Invention

The present invention relates to computer model of hydrodynamic flows and more particularly, relates to modeling partially cavitating flows over a supercavitating axisymmetric body.

(2) Description of the Prior Art

Modeling of boundary flows about objects subject to laminar and turbulent flows is well known in the art. High speed underwater vehicles, however, cause cavitation of the surrounding fluid. Cavitation reduces pressure in the fluid below its vapor pressure causing the fluid to vaporize, allowing the undersea vehicle to travel with lower friction when the vehicle is completely surrounded by the cavity.

Partial cavitation is an unsteady phenomenon that occurs when part of the supercavitating vehicle is traveling in the cavity. Specifically, this phenomenon occurs during launch of the vehicle. A steady, partial cavitation allows development of vehicle designs which take advantage of drag reduction through cavitation. It may also be possible to take advantage of drag reduction with partial cavitation by properly directing the re-entrant jet that forms in the cavity closure region. Partial cavitation often occurs during maneuvering of the supercavitating vehicle.

A slender body theory has been developed to solve axisymmetric supercavitating flows. Using the slender body method, sources are defined along the body-cavity axis and control points along the body-cavity surface. A nonlinear differential equation is formed by imposing dynamic boundary conditions on the cavity. A conical cavity closure is assumed in order to solve the developed nonlinear differential equation.

A non-linear boundary element method for determining a cavity shape has been developed. Source and dipole strengths along the body-cavity surface are determined using kinematic boundary conditions on the wetted body surface and dynamic boundary conditions on the assumed cavity shape. The kinematic boundary condition is then used to update the cavity shape. The process is then iterated to solve for the unknown cavity shape.

Two numerical hydrodynamics models have been developed by the Naval Undersea Warfare Center for axisymmetric super cavitating high speed bodies. These models are the slender body theory (SBT) model and the boundary element (BE) model. Both of these models have been proven to predict cavity shape and parameters with good accuracy.

These models, however, do not account for the transition case when the vehicle is subjected to only partial cavitation.

In the SBT model, total drag is predicted by adding the pressure drag obtained from the model solution and the viscous drag obtained by applying the Thwaites and Falkner-Skan approximations along the wetted portions of the cavitator. This method is extended to subsonic compressible flows using the compressible Green's function. In the BE model, sources and dipoles are defined on the body-cavity shape and are solved using Green's formula. This yields a Fredholm integral equation of the second kind which gives the supercavitating cavity shape.

Partial cavitation modeling has been done by Uhlman, J. S. (1987), The Surface Singularity Method Applied to Partially Cavitating Hydrofoils, Journal of Ship Research, Vol. 31, No. 2, pp. 107–24; Uhlman, J. S. (1989), The Surface Singularity or Boundary Integral Method Applied to Supercavitating Hydrofoils, Journal of Ship Research, Vol. 33, No. 1, pp. 16–20; Kinnas, S. A., and Fine, N. E. (1990), Non-Linear Analysis of the Flow Around Partially and Super-Cavitating Hydrofoils by a Potential Based Panel Method, Proceedings of the IABEM-90 Symposium, International Association for Boundary Element Methods, Rome, Italy, and Kinnas, S. A., and Fine, N. E. (1993), A Numerical Nonlinear Analysis of the Flow Around Two- and Three-Dimensional Partially Cavitating Hydrofoils, Journal of Fluid Mechanics, Vol. 254. However, these methods are explicitly adapted for hydrofoils, and the theories presented therein are not readily adapted to supercavitating vehicles.

SUMMARY OF THE INVENTION

One object of the present invention is a method for modeling partial cavitation.

Another object is that such method model partial cavitation about an axisymmetric vehicle.

Accordingly, the present invention provides a method for calculating cavity shape for partial cavities about an axisymmetric body having a cavitator located at the foremost end. The method includes receiving system parameter data including geometric data describing the axisymmetric body, a cavity length, and a convergence tolerance. Boundary element panels are distributed along the body-cavity surface and matrices are initialized for each boundary element panel using the unit dipole, unit source functions and known boundary values. Disturbance potential matrices are formulated for each boundary element panel using disturbance potentials, normal derivatives of disturbance potentials, and no net flux boundary conditions. The initialized matrices and the formulated matrices are solved for each boundary panel to obtain unknown disturbance potentials along the wetted body-cavity surfaces, and normal derivatives of disturbance potentials along the cavity surface. The cavity position is then updated by moving each panel to satisfy the kinematic boundary condition, no flux across the cavity. The method then tests for convergence against a tolerance, and steps are iterated until convergence is achieved. The method then provides parameters of interest and the location of the cavity as output. Another aspect of this invention allows the calculation of cavity shape and cavity length for an input cavitation number. This is accomplished by an outer loop adjusting cavity length until the model converges to the input cavitation number.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
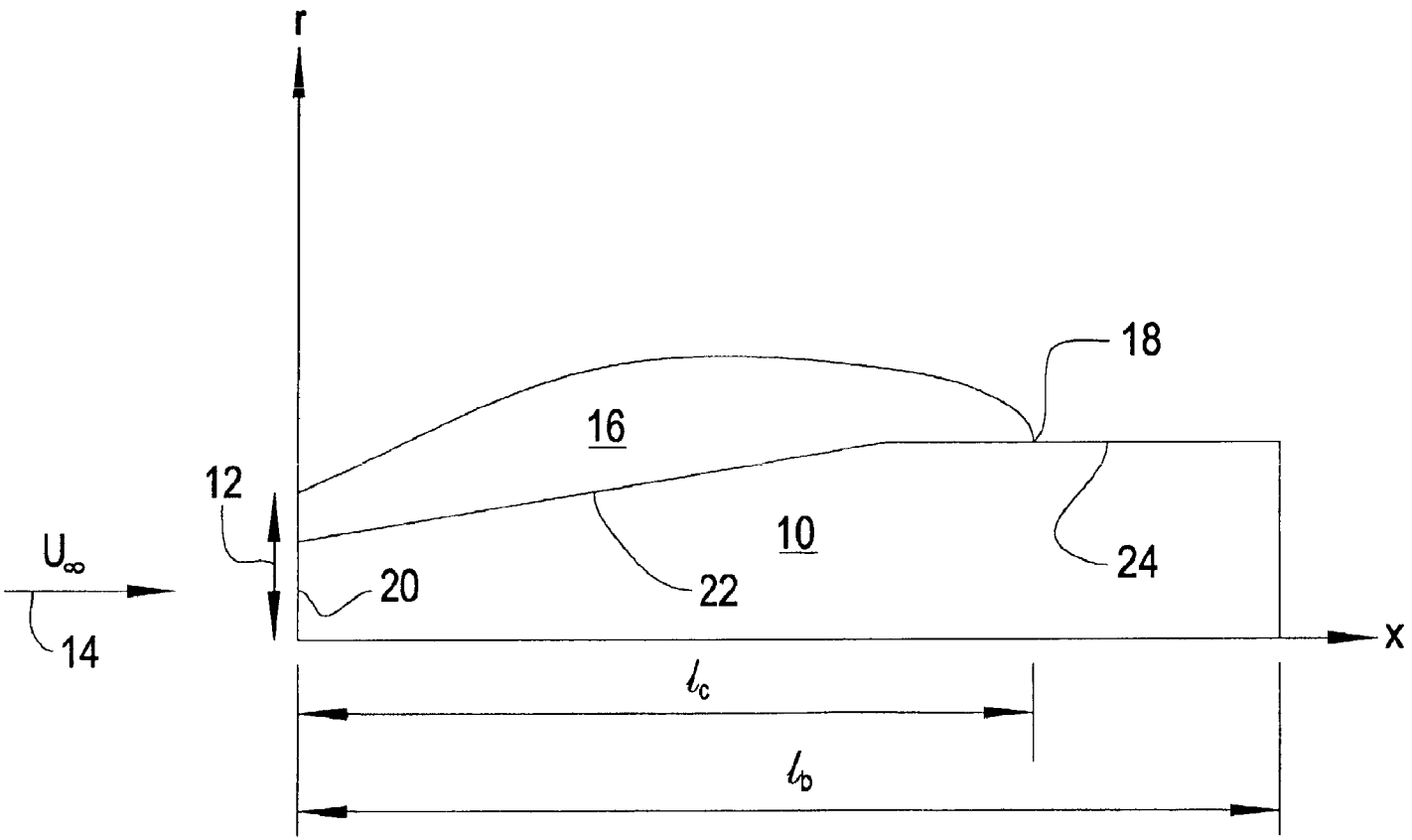
FIG. 1 is a diagram of a partially cavitating axisymmetric body related to the method of the current invention.

FIG. 1 shows a diagram of the physical problem of partial cavitation. FIG. 1 shows a radial cross section of an axisymmetric body 10. Axis r represents the radius from the axis of body 10. Axis x represents the length along the body 10 measured from a cavitator disk 12. Although a cavitator disk is shown, the model can calculate cavities for cavitator cones as well as cavitator disks. Flow, $U_\infty$, is in the direction of arrow 14. A cavity 16 is shown extending from the edge of the cavitator along the length of body 10. The length of the cavity, $l_c$, is shown by dimension arrows. Likewise, the length of the body, $l_b$, is also shown by dimension arrows.

Body 10 extends beyond a cavity closure 18. Cavity 16 is closed to the body 10 with a modified Riabouchinsky cavity termination wall. Cavity closure 18 can be positioned in either body conical section 22 or body cylindrical section 24. The plane of cavity closure 18 is referenced in the following disclosure as an endplate.

Body 10 has a flat front area 20 followed by a conical section 22 and a cylindrical section 24. The diameter of flat front area 20 should be less than or equal to the diameter of the cavitator disk 12 base.

The mathematical formulations in of this algorithm are based on using the cavitator diameter to remove dimensionality for all lengths and using the free stream velocity, $U_\infty$, to remove dimensionality for all velocities. Alternate formulations using standard units can also be developed.

The flow field is governed by Laplace's equation, $$\nabla^2\Phi=0 \tag{1}$$

where $\Phi$ is the total potential which is the sum of free stream potential, $\Phi_\infty$, and disturbance potential, $\phi$, giving:

$$\Phi=\phi_\infty+\phi \tag{2}$$

The free stream potential is the product of the velocity and the distance, x. Because the equation has been non-dimensionalized, the velocity is 1, and the free stream potential, $\phi_\infty$, is x. The disturbance potential, $\phi$, also obeys Laplace's equation, giving:

$$\nabla^2\phi=0 \tag{3}$$

The disturbance potential satisfies Green's third identity, yielding a Fredholm integral equation of the second kind along the cavitator, cavity, endplate and body. Thus, at any point, x, on the body-cavity surface, the disturbance potential can be computed from:

$$2\pi\phi(x) = \oint\!\!\oint_S \left[\phi(x)\frac{\partial}{\partial n}G(x;x') - \frac{\partial}{\partial n}\phi(x)G(x;x')\right]dS \tag{4}$$

where x' are the points where the sources and dipoles are distributed under the boundary element model;

S is the body-cavity surface; and

G(x,x') is the Green function.

The Green function is further identified as:

$$G(x,x') = \frac{1}{|x-x'|} \tag{5}$$

The dynamic condition on the cavity boundary is derived from Bernoulli's equation. Along the cavity surface, this can be written as:

$$p_\infty + \frac{1}{2}\rho U_\infty^2 = p_c + \frac{1}{2}\rho U_S^2 \tag{6}$$

where $P_\infty$ is the free stream ambient pressure;

$\rho$ is the free field fluid density;

$p_c$ is the pressure inside the cavity; and $U_s$ is the flow velocity at the cavity surface.

The flow velocity at the cavity surface can be obtained from equation (6) giving:

$$U_S = \sqrt{1+\sigma} \tag{7}$$

where $\sigma$ is the cavitation number which is defined as:

$$\sigma = \frac{p_\infty - p_c}{\frac{1}{2}\rho U_\infty^2} \tag{8}$$

The kinetic boundary condition is that no flow crosses the body-cavity boundary, $$\frac{\partial\phi}{\partial n} = -n_x \tag{9}$$

where $n_x$ is the axisymmetric body free-stream velocity power. The no net flux condition, $$\oint\!\!\oint_S \frac{\partial\phi(x)}{\partial n}dS = 0 \tag{10}$$

is also required to make the problem a determinate system.

Total drag is calculated by adding the drag coefficients. The pressure drag coefficient, $C_p$, at $\bar{x}$ is calculated as follows:

$$C_p=1-U(\bar{x})^2 \tag{11}$$

The pressure contribution to the drag coefficient may then be computed as:

$$C_{dp} = \frac{4}{\pi}\oint\!\!\oint_S C_p n_x dS \tag{12}$$

The viscous contribution to the drag coefficient along the wetted portions of the conical and cylindrical body areas is calculated using the International Towing Tank Conference equation given by Newman, *Marine Hydrodynamics*, MIT Press, Cambridge, Mass. 1980, for the friction coefficient, $C_f$, at $\bar{x}$ is as follows:

$$C_f = \frac{0.075}{(\log_{10}(R(\bar{x}) - 2))^2} \tag{13}$$

where $R(\bar{x})$ is the local Reynolds number. The total viscous drag coefficient, $C_{dv}$, is:

$$C_{dv} = \frac{4}{\pi} \oiint_S C_f s_x dS \tag{14}$$

The base drag coefficient, $C_{db}$, which is the component of pressure drag associated with the base of the body is:

$$C_{db} = \frac{0.029(2b_{base})^3}{\sqrt{C_{dv}}}, \tag{15}$$

where $b_{base}$ is the body radius at the base. The total drag coefficient is then given by $$C_d = C_{dp} + C_{dv} + C_{db} \tag{16}$$

The panels are distributed along the cavitator, cavity, endplate, and cylindrical body section aft of the cavity, according to the partial floor method, known in the art. The partial floor method optimizes the number of panels in accordance with requirements for getting good convergence. Non-uniform panel spacing is used in many locations, in order to reduce the number of panels without reducing the accuracy of the solution.

During iteration, the end plate height is determined by integrating the cavity surface back from its detachment point on the cavitator, and the number and distribution of panels along the endplate changes according to the changes in the endplate height. Smaller panels are required at highly non-linear flow locations, such as the region near the cavitator. Panel distribution in the wetted body area after cavity closure 18 changes to keep the aspect ratio of the neighboring panels between 0.5 and 2.0, in order to ensure good accuracy of the results.

In following the method of the current invention, first an initial cavity is defined. An arbitrary initial cavity can be chosen as a cone extending from the cavitator edge to an assumed endplate height of 0.2 or 0.3 is sufficient for most cases. In this discussion, the endplate height is measured as the radial offset from the body surface to the last point of the cavity. By applying equation (4) on all panels along the cavity body surface, S, a system of equations is obtained. This system is solved for the disturbance potentials, $\phi$, along the wetted portions of the boundary and on the Riabouchinsky endplate; the normal derivative of the disturbance potential along the cavity boundary; and the cavitation number.

The kinetic boundary condition given in equation (9) is applied along cavitator, endplate, and aft body to update the cavity shape. In order to update the cavity, the program calculates how much each panel has to be rotated to satisfy the no flow condition. The program starts with the first panel at the cavitator and shifts the aft most point of the panel in the radial direction which satisfies the calculated rotation. The panel is rotated with the aft most point. The foremost point of the next panel is then shifted to the same radius as the previous aft most point. This process is continued until the panel adjacent to the endplate is undated. The endplate height is adjusted to the aft most point of the aft cavity panel. The iteration continues until the kinetic boundary condition converges to within a tolerance, giving the cavity shape.

From the converged disturbance potential along S, the disturbance velocity components can be calculated:

$$u_x = \frac{\partial \phi}{\partial x} \text{ and } u_r = \frac{\partial \phi}{\partial r}. \tag{17}$$

Figure 2:
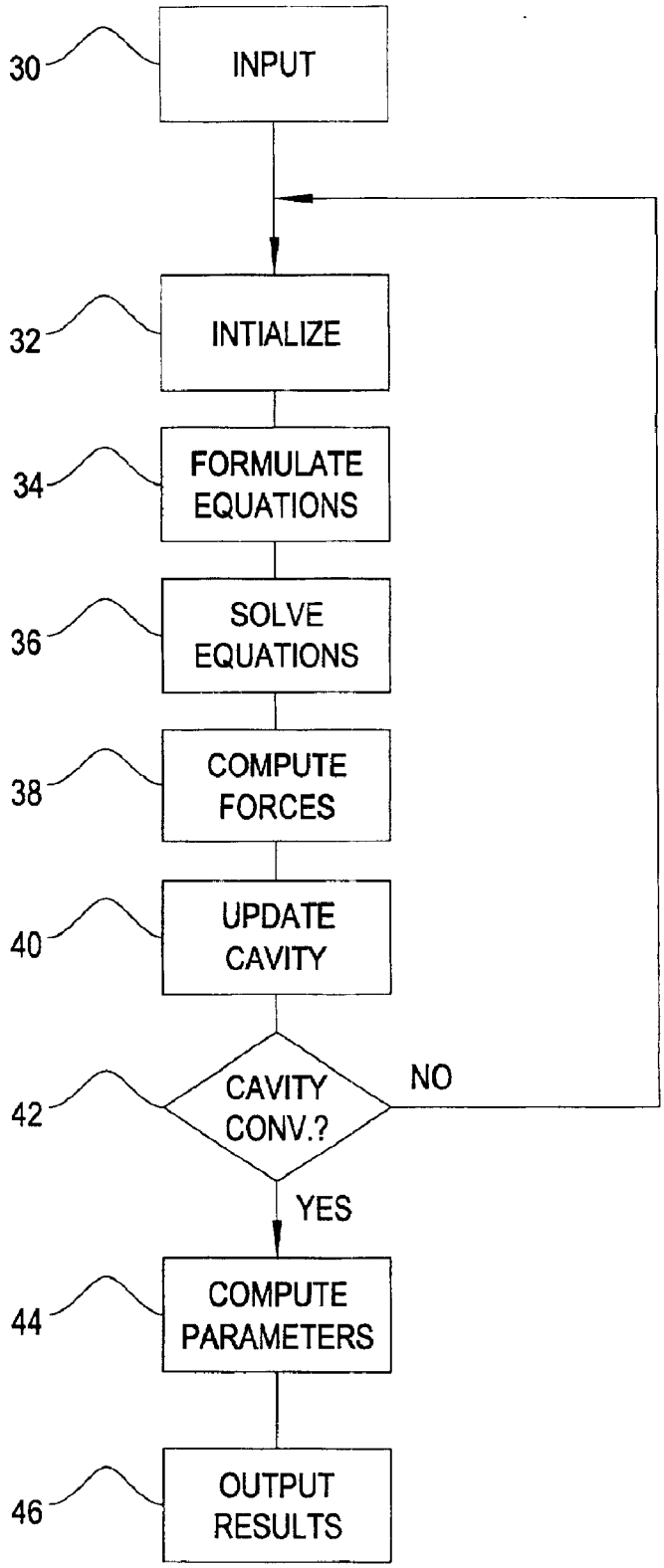
FIG. 2 is a flow chart of the method of the current invention.

Referring now to FIG. 2, there is shown a flowchart of the current invention. In the input step 30, geometric and other system parameter data including the estimated cavitation number, the estimated cavity length and the convergence criteria is read. The routine then distributes boundary element panels along the cavitator, cavity, endplate, body extension in the conical section, body extension in the horizontal section, and the aft body. The panels are distributed in order to reduce the number of panels and get an accurate result. In the initialize step 32, the algorithm calculates the unit dipole and unit source functions and initializes matrices for the influence functions with known boundary values wherever applicable. The formulate equations step 34 formulates matrices for each panel using the disturbance potential equation (4) and no net flux condition given in equation (9). The solve equations step 36 solves the matrices created in the formulate equations step 34 in order to obtain the unknown disturbance potential along wetted body sources, normal distributions of disturbance potentials along cavity surfaces, and the cavitation number. The compute forces step 38 computes velocity components such as those in equation (17) and drag coefficients: including pressure drag, equation (12); viscous drag, equation (14); and base drag, equation (15) from the solved equations. In the update cavity step 40, the cavity is updated from the computed forces using the kinetic boundary condition of equation (9). Convergence on cavity shape is checked in the converges decision step 42. If the cavity is not converged, the initialize step 32 is executed to calculate influence functions for the updated cavity and next iteration thus begins. Once the cavity has converged, the compute parameters step 44 computes various output parameters of the converged solution which include pressure drag, viscous drag, base drag, total drag, cavitation number, cavity length, maximum cavity radius, length of cavity to maximum radius location. The output results step 46 then provides the location of the cavity written as coordinates and the cavity's disturbance potential, disturbance potential gradient, and pressure coefficient.

Figure 3:
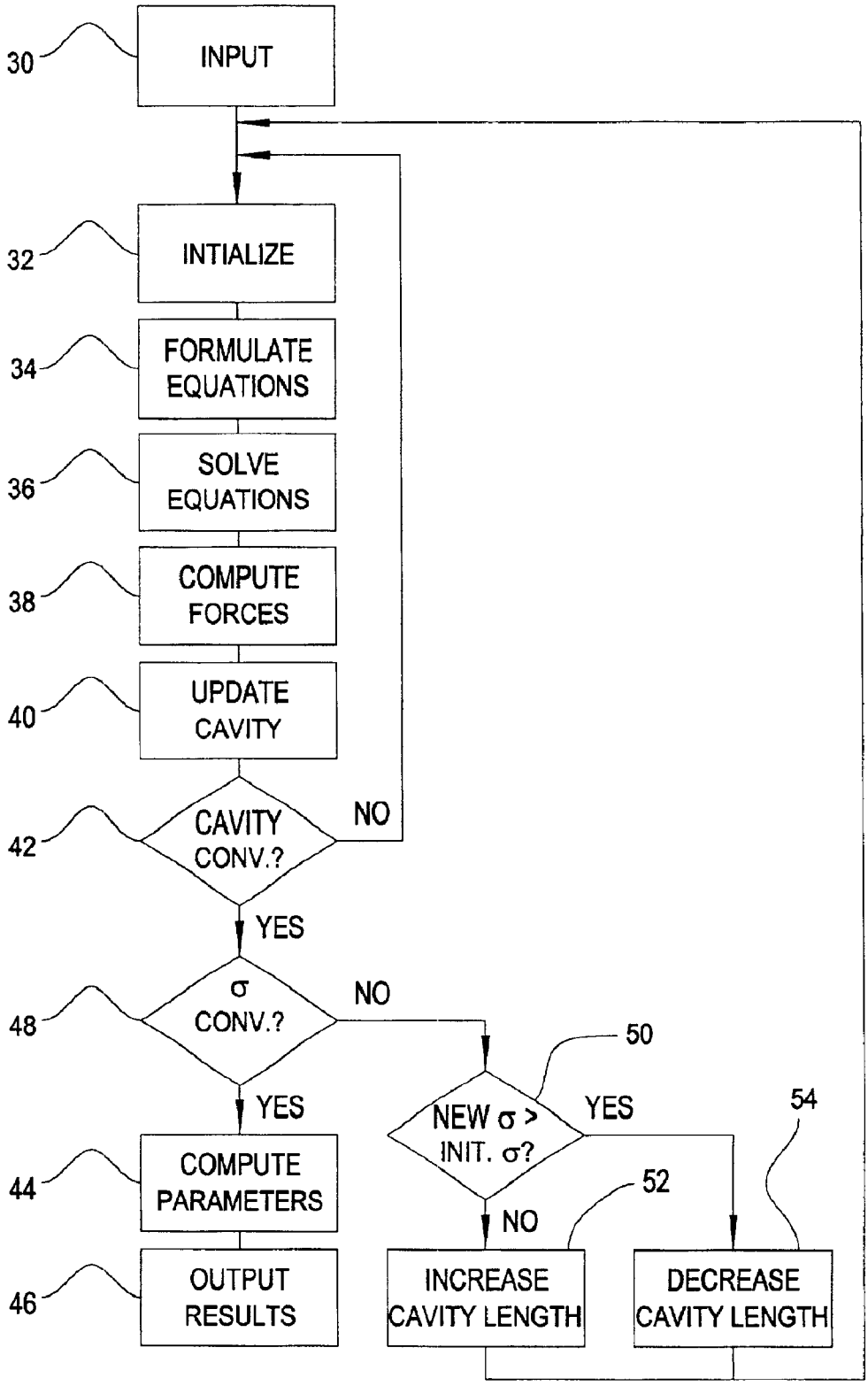
FIG. 3 is a flow chart of another method of the current invention.

The basic algorithm enumerated above provides cavity shape and cavitation number based on an input cavity length. In order to obtain cavity shape and cavity length for an input cavitation number, the embodiment of FIG. 3 adds an additional series of iterations. The user inputs a cavitation number and an assumed cavity length. This embodiment follows the previous embodiment in converging on a new cavitation number, $\sigma$, for the assumed cavity length. In step 48, if the new cavitation number is within a tolerance of the given cavitation number, parameters are computed, step 44, and the results are provided, step 46. Otherwise the embodiment proceeds to step 50 wherein the algorithm determines the relationship between the new cavitation number, $\sigma$, and the given cavitation number. In step 52, cavity length is increased by a predetermined amount if the calculated cavitation number is lower than the initial cavitation number, and in step 54 the cavity length is decreased by a predetermined amount if the calculated cavitation number is greater than the initial cavitation number. The routine loops back to the initialize step 32 and recalculates the cavitation number for the new cavity length. Operation continues until the calculated cavitation number falls within a tolerance of the initial cavitation number, the cavity length has converged, as tested in step 48.

Using this invention; partial cavitation for high-speed underwater bodies can be analyzed. As disclosed, the invention can analyze axisymmetrical bodies using two cavitator shapes, a disk and a cone; however, the invention can easily be modified to analyze other axisymmetric cavitator shapes. As disclosed the inventive method can converge on cavity length or cavitation number. Total drag is calculated by adding the pressure drag, viscous drag and base drag. The invention can also be utilized for studying the effects of body aft radius, body cone angle and body cone angle starting at the cavity closure if the closure is on conical section 22. This method provides new information concerning the physics of cavitation which can be used in the design of cavitating vehicles.

In light of the above, it is therefore understood that within the scope of the appended claims, the invention may be practiced otherwise than as specifically described.

What is claimed is:

1. A method for calculating parameters for an axisymmetric partially cavitating body having a cavitator located at the foremost end, said method comprising the steps of:

receiving system parameter data including geometric data describing the axisymmetric body, a convergence tolerance, and an initial cavity shape including an endplate height, an endplate location, and a cavity length;

initially distributing boundary element panels along the initial cavity shape, endplate and the axisymmetric body aft of the endplate;

initializing matrices for each boundary element panel using the disturbance potentials at the boundary element panels and known boundary values;

formulating disturbance potential matrices for each boundary element panel utilizing disturbance potential equations and no net flux boundary conditions;

solving initialized matrices and formulated disturbance potential matrices for each boundary panel to obtain unknown panel sources, unknown dipoles and unknown cavitation numbers;

computing forces and velocities at each panel from the panel sources, dipoles and cavitation numbers to obtain velocity components, pressure drag, viscous drag, and base drag;

updating the cavity by moving each panel in accordance with the calculated forces and velocities and the boundary conditions;

testing for convergence by comparing the movement of each panel against the convergence tolerance;

iterating said steps of initializing matrices, formulating matrices, solving formulated matrices, computing forces and velocities, updating the cavity and testing for convergence when said test for convergence indicates that movement of at least one panel exceeds the convergence tolerance;

computing parameters of interest when said test for convergence indicates that movement of all panels is within the convergence tolerance; and outputting the location of the cavity and the computed parameters.

2. The method of claim 1 wherein the step of computing parameters of interest comprises computing the pressure drag, the viscous drag, the base drag, the total drag, the cavitation number, the cavity length, the maximum cavity radius, and the cavity length to maximum radius location.

3. The method of claim 2 wherein the output results step further includes outputting the cavity's disturbance potential, disturbance potential gradient, and pressure coefficient.

4. The method of claim 3 wherein the output results step further comprises outputting all system parameter data, panel locations, and cavitation numbers for each iteration.

5. The method of claim 1 wherein the updating the cavity step comprises the steps of:

calculating the rotation of a boundary element panel necessary for satisfying the no flow boundary condition for a panel of interest starting with the boundary element panel closest to the cavitator;

shifting the aft most point of the panel of interest in the radial direction for satisfying the calculated rotation;

moving the foremost point of the next aftward panel to the same radius as the shifted aft most point of the panel of interest; and continuing calculating, shifting and moving for each panel foremost to aft most until the panel adjacent to the endplate is updated.

6. The method of claim 1 wherein the convergence tolerance comprises a maximum radial displacement for each panel.

7. A method for calculating cavity length for an axisymmetric partially cavitating body having a cavitator located at the foremost end, said method comprising the steps of:

receiving system parameter data including geometric data describing the axisymmetric body, a cavitation number, a convergence tolerance, a cavitation number tolerance, and an initial cavity shape including an endplate height, an endplate location, and a cavity length;

initially distributing boundary element panels along the initial cavity shape, endplate and the axisymmetric body aft of the endplate;

initializing matrices for each boundary element panel using the disturbance potentials at the boundary element panels utilizing known boundary values;

formulating disturbance potential matrices for each boundary element panel utilizing disturbance potential equations and no net flux boundary conditions;

solving initialized matrices and formulated disturbance potential matrices for each boundary panel to obtain unknown panel sources, unknown dipoles and unknown cavitation numbers;

computing forces and velocities at each panel from the panel sources, dipoles and cavitation numbers to obtain velocity components, pressure drag, viscous drag, and base drag;

updating the cavity by moving each panel in accordance with the calculated forces and velocities and the boundary conditions;

testing for convergence by comparing the movement of each panel against the convergence tolerance;

iterating said steps of initializing matrices, formulating matrices, solving formulated matrices, computing forces and velocities, updating the cavity and testing for convergence when said test for convergence indicates that movement of at least one panel exceeds the convergence tolerance;

computing a current cavity and a current cavitation number when said test for convergence indicates that movement of all said panels are within the convergence tolerance;

indicating cavitation number convergence when said current cavitation number is within the cavitation number tolerance from the received cavitation number;

increasing said cavity length to provide a new cavity length when said current cavitation number is less than said received cavitation number beyond the cavitation number tolerance;

decreasing said cavity length to provide a new cavity length when said current cavitation number is greater than said received cavitation number beyond the cavitation number tolerance;

iterating the steps of initially distributing, initializing matrices, formulating disturbance potential matrices, solving initialized matrices and formulated disturbance potential matrices, computing forces and velocities, updating the cavity, testing for convergence, iterating, and computing a current cavity and a current cavitation number using said new cavity length when cavitation number convergence is not indicated;

computing parameters of interest when cavitation number convergence is indicated; and outputting the location of the cavity and the computed parameters.

8. The method of claim 7 wherein the step of computing parameters of interest comprises computing the pressure drag, the viscous drag, the base drag, the total drag, the maximum cavity radius, and the cavity length to maximum radius location.

9. The method of claim 8 wherein the output results step further includes outputting the cavity's disturbance potential, disturbance potential gradient, and pressure coefficient.

10. The method of claim 9 wherein the output results step further comprises outputting all system parameter data, panel locations, and cavitation numbers for each iteration.

11. The method of claim 7 wherein the updating the cavity step comprises the steps of:

calculating the rotation of a boundary element panel necessary for satisfying the no flow boundary condition for a panel of interest starting with the boundary element panel closest to the cavitator;

shifting the aft most point of the panel of interest in the radial direction for satisfying the calculated rotation;

moving the foremost point of the next aftward panel to the same radius as the shifted aft most point of the panel of interest; and continuing calculating, shifting and moving for each panel foremost to aft most until the panel adjacent to the endplate is updated.

12. The method of claim 7 wherein the convergence tolerance comprises a maximum radial displacement for each panel.

* * * * *